US005354235A

United States Patent [19]

Rittle et al.

[11] Patent Number: 5,354,235

[45] Date of Patent: Oct. 11, 1994

[54] AIR SWEEP MECHANISM

[76] Inventors: Jon D. Rittle, 85 Tappan St., Baldwinsville, N.Y. 13027; Richard D. Dennis, 1429 Lestina Rd., Bridgeport, N.Y. 13030

[21] Appl. No.: 164,866

[22] Filed: Dec. 10, 1993

[51] Int. Cl.[5] ..... F24F 13/075

[52] U.S. Cl. ..... 454/285; 454/317

[58] Field of Search ..... 454/153, 202, 285, 317, 454/313, 320, 321

[56] References Cited

U.S. PATENT DOCUMENTS 5,299,978 4/1994 Dennis et al. ..... 454/285

FOREIGN PATENT DOCUMENTS 173048 8/1986 Japan ..... 454/285

259051 11/1986 Japan ..... 454/285

194160 8/1987 Japan ..... 454/313

*Primary Examiner*—Harold Joyce

[57] ABSTRACT

A shaft extends across an air discharge opening and is rotatably mounted therein. A drive means is operatively connected to the shaft for rotating the shaft on its axis. A plurality of planar discs, are eccentrically mounted on the shaft. A pair of adjacent louver blades extending across the air discharge opening are pivotally mounted at their one edge in the air discharge opening. A spring is connected to the louver blades for biasing then into an engaging relationship with the discs such that, as the discs rotate, the louver blades are caused to rotate on their axes to cause a change in the direction of airflow emanating from the discharge opening.

11 Claims, 3 Drawing Sheets

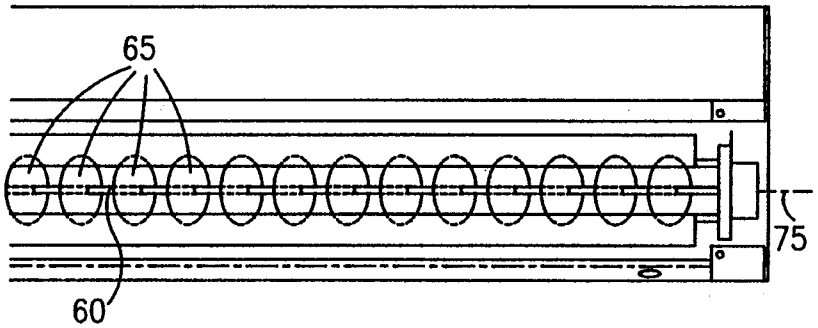
FIG.4A
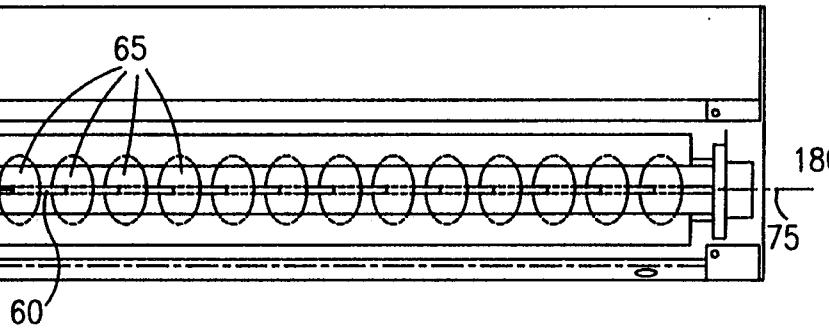
FIG.4B
FIG.4C
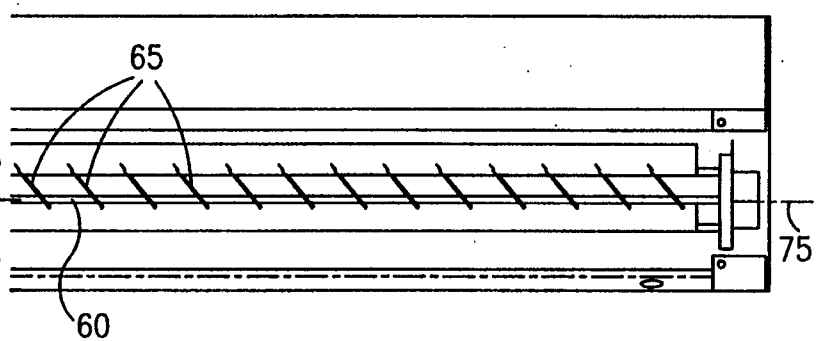
FIG.4D

AIR SWEEP MECHANISM

BACKGROUND OF THE INVENTION

1. Field of the Invention

This invention relates to an air sweep mechanism disposed in an air discharge opening of an air conditioning system to sweep the discharged air across both the horizontal and vertical planes.

2. Description of the Background Art

Air conditioning systems are typically provided with discharge openings from which conditioned air may be distributed to a desired area. The discharge openings are commonly supplied with a mechanism which includes louvers for controlling the direction of the airflow emanating therefrom. The louvers may be used to improve the air distribution performance of these systems. For example, to provide improved air distribution performance it has become common practice to employ sweeping mechanisms which include a driving device for moving the louvers back and forth to sweep the conditioned air from top to bottom or side to side. It should be noted, however, that these mechanisms typically include a complex linkage between the louvers and the driving device.

The louvers are also used to control the "throw" of the conditioned air. Controlling the throw of the conditioned air refers to the ability to control the depth distribution of the conditioned air. An increase in the throw corresponds to an increase in the depth of the air distribution into the desired area. To provide an increase in the conditioned air's throw, some sweeping mechanisms periodically adjust the louvers to a non-parallel position to pinch the air that flows between the louvers. This periodic pinching increases the air speed, thereby increasing the throw of the airflow. Such an apparatus is shown and described in U.S. Pat. No. 5,299,978 issued on Apr. 5, 1994 to the assignee of the present invention. While this apparatus provides up-and-down air distribution and periodic thrusting of the air, there are certain features of the design which are undesirable. For example, it does not provide side-to-side sweeping of the conditioned air, and the linkage mechanism between the louvers and the driving device is relatively complex.

SUMMARY OF THE INVENTION

It is an object of the present invention to provide an improved air sweep mechanism for an air conditioning system.

It is a further object of the present invention to provide an air sweep mechanism with an enhanced air distribution performance.

It is another object of the present invention to provide an improved air sweep mechanism which sweeps both horizontally and vertically while also providing a periodic increase in the air's throw.

It is yet another object of the present invention to provide an air sweep mechanism which does not require a direct linkage between the louvers and the driving device.

Yet another object of the present invention to provide an air sweep mechanism which is economical to manufacture and effective in use.

Briefly, in accordance with one aspect of the present invention, a shaft extends across an air discharge opening and is rotatably mounted therein. A drive means is operatively connected to the shaft for rotating the shaft on its axis. A plurality of discs, which are substantially planar in form, are eccentrically mounted on the shaft. A pair of adjacent louver blades extending across the air discharge opening are pivotally mounted in the air discharge opening. A biasing means is connected to the louver blades for biasing them to an engaging relationship with the peripheries of the discs such that as the discs rotate, the louver blades are caused to move so as to vertically sweep the airflow emanating from the discharge opening.

In accordance with a further aspect of the invention, the discs are preferably mounted on the shaft such that each disc has its plane at an angle with respect to a plane normal to the shaft's axis. This causes the discs, as they rotate, to horizontally sweep the airflow as it passes over the discs.

The foregoing and other objects, features and advantages of the present invention will become more apparent in light of the following description and accompanying drawings.

BRIEF DESCRIPTION OF THE DRAWINGS

The novel features that are considered characteristic of the invention are set forth with particularity in the appended claims. The invention itself, however, both as to its organization and its method of operation, together with additional objects and advantages thereof, will best be understood from the following description of the preferred embodiment when read in connection with the accompanying drawings wherein like numbers have been employed in the different figures to denote the same parts, and wherein;

FIGS. 4A through 4D are schematic illustrations of the present invention in various operational positions as the drive means completes a full revolution.

DETAILED DESCRIPTION OF THE PREFERRED EMBODIMENT

Figure 1:
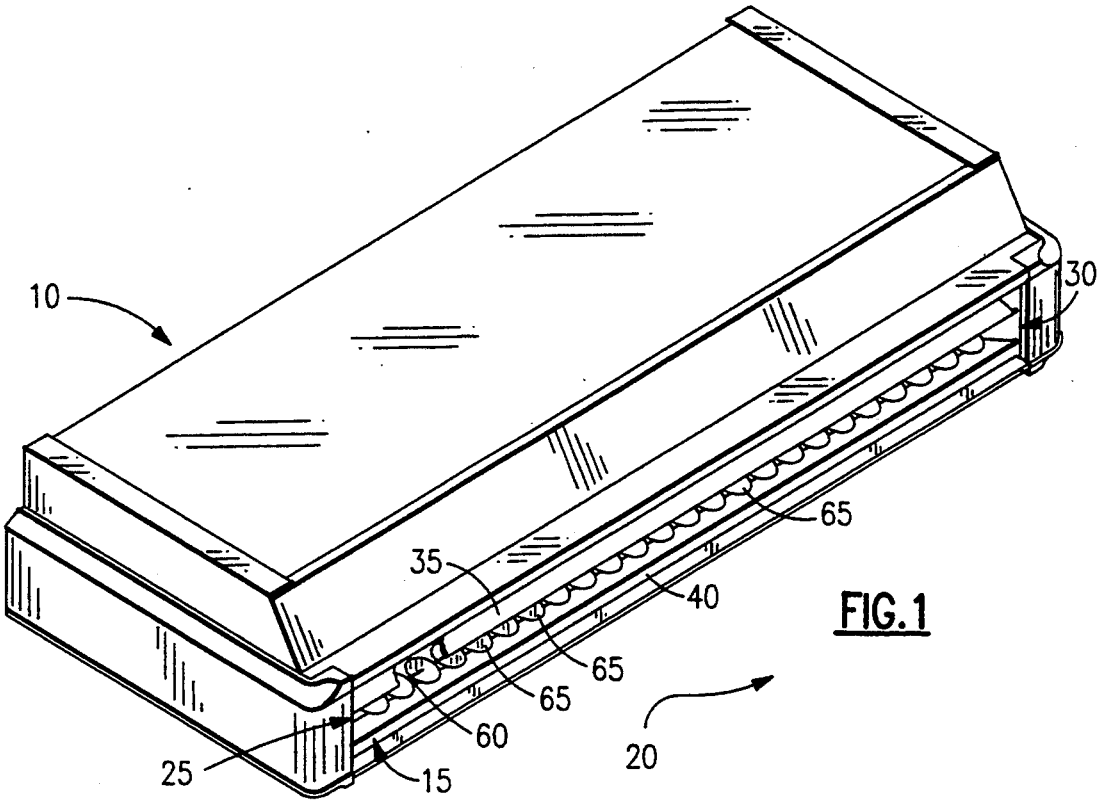
FIG. 1 is a perspective view of an air conditioner system with the present invention incorporated therein.
Figure 2:
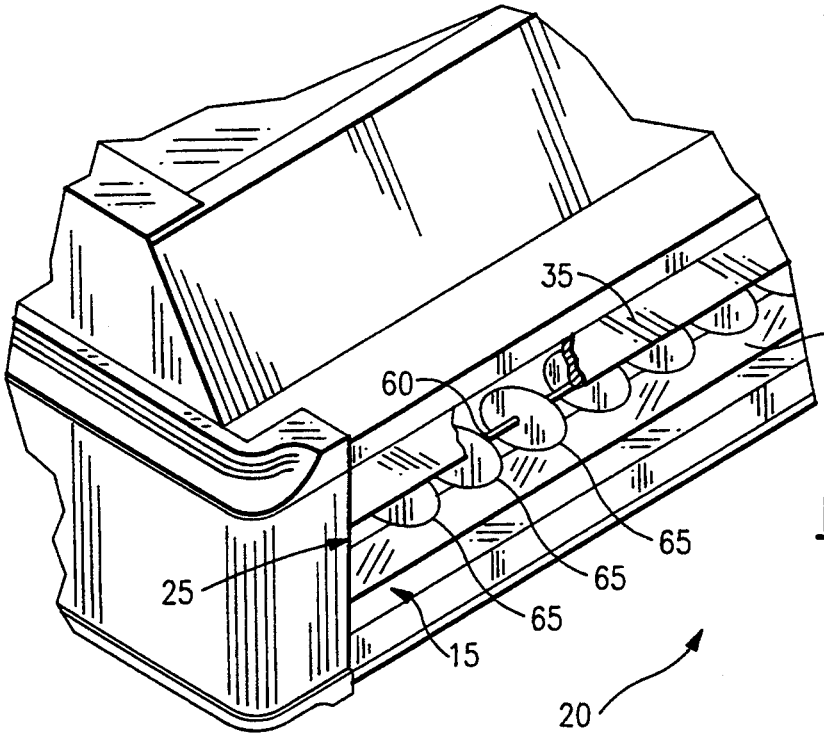
FIG. 2 is a magnified partial perspective view of an air conditioner system with the present invention incorporated therein as shown in FIG. 1.

Referring to FIGS. 1 and 2, an air conditioner system 10 with the present invention incorporated therein is shown. The air conditioner system 10 includes a fan (not shown) which causes conditioned air to flow through a discharge opening 15 and into a desired area 20. The discharge opening has two ends 25,30. A pair of adjacent louver blades 35,40 are positioned in the discharge opening 15, such that, as the conditioned air passes between the louver blades 35,40, the louver blades 35,40 direct the conditioned air into the desired area 20. Each louver blade 35,40 has first 45 and second 50 edges and is mounted pivotally in the discharge opening 15 about its first edge 45 (shown in FIG. 3A). The first edge 45 of each of the louver blades 35,40 is pivotally mounted between and supported by the ends 25,30 of the discharge opening. The positions of the louver blades 35,40 determine both the direction and speed of the conditioned air and are controlled by a drive means 55 (shown in FIG. 3A) which cooperates with the present invention as will be shown hereinbelow.

A drive means 55 (shown in FIG. 3A) is disposed inside the air conditioning system 10 near one end 25,30 of the discharge opening 15. The drive means 55 is driving connected to a shaft 60 which is disposed across the air discharge opening 15 with one end connected to the drive means 55 and the other end rotatable mounted to the other end 25,30 of the discharge opening 15. The pair of louvers blades 35,40 are disposed in the discharge opening such that they are on opposite sides of the shaft 60 with respect to each other. It should be understood by a person skilled in the art that the drive means 55 may be a motor or any device which is capable of causing a shaft 60 to rotate.

A plurality of discs 65, which are substantially planar in form, are mounted on the shaft 60 in laterally spaced relationship along the shaft's length. Each disc 65 is mounted to the shaft 60 such that the distance between at least one point on the periphery of the disc 70 and the shaft's axis 75 (shown in FIGS. 4A–4D) is large as compared to the distance between another point on the periphery of the disc 70 and the shaft's axis 75 (shown in FIGS. 4A–4D); preferably, this is accomplished by eccentrically mounting elliptically shaped discs 65 on the shaft. The elliptical shape of the discs 65 can be described by the following formula: $x \wedge 2/a \wedge 2 + y \wedge 2/b \wedge 2 = 1$; where "a" is the largest diameter of the ellipse and "b" is the smallest diameter of the ellipse. This mounting configuration causes the discs 65 to produce a desired rotational pattern as the discs 65 are rotated by the drive means 55 as will be more fully described hereinbelow. It should be understood by one skilled in the art that other mounting configurations, such as eccentrically mounted circular discs or centrally mounted elliptical discs, may be used to achieve substantially the same result.

In addition to the above-mentioned mounting configuration, the discs 65 are preferably mounted on the shaft 60 such that each disc 65 has its plane at an angle (e.g. 45°) with respect to a plane normal to the shaft's axis. This causes the discs 65 to govern the side-to-side air sweep movement of the conditioned air as it passes over the discs 65 as will be more fully described hereinbelow.

Referring now to FIGS. 3A–3H, tension springs 80 are connected at their ends to the pair of louver blades 35,40 for causing an engaging relationship between the discs 65 and the pair of louver blades 35,40. Preferably, one tension spring 80 is disposed near each end of the air discharge opening 25,30 for properly biasing the louver blades 35,40 against the discs 65. It should be understood by someone skilled in the art that various placements of the tension springs 80 along the shaft 60, such as at periodic intervals between the discs 65, may be used to achieve substantially the same result.

The engaging relationship caused by the tension springs 80 allows the discs 65 to control the position of the louver blades 35,40 as the discs 65 rotate about the shaft's axis 75 (shown in FIGS. 4A–4D). More specifically, as the drive means 55 rotates the shaft 60, which in turn rotates the discs 65, the discs 65 cause the louver blades 35,40 to pivot about their first edges 45 which in turn alters the angle of the louver blades 35,40. The angle of the louver blades 35,40 governs the direction and the speed of the conditioned air which passes over the louver blades 35,40 as will be described below.

The radial distance between the shaft's axis 75 and the point on the disc's outer periphery 85 which is engaging the louver blade 35,40 will govern the rotational position of the louver blade 35,40 about its first edge 45. For example, as the discs 65 rotate, the radial distance between the shaft's axis 75 and the point on the disc's outer periphery 85 which is engaging the louver blade 35,40 may increase or decrease, depending upon the shape of the discs 65 and the mounting configuration of the discs 65. If the radial distance increases, as the discs 65 rotate, then the discs 65 will cause the louver blades 35,40 to pivot about their first edges 45, and the second edges 50 of the louver blades 35,40 will move away from the shaft's axis 75. If the radial distance decreases, as the discs 65 rotate, then the spring 80 will cause the louver blades 35,40 to maintain contact with the discs 65, thus causing the louver blades 35,40 to pivot about their first edges 45, and the second edges 50 of the louver blades 35,40 will move toward the shaft's axis 75. The movement of the second edge 50 of the louver blades 35,40 changes the angle of the louver blades 35,40 which in turn changes the direction and the speed of the conditioned air which passes over the louver blades 35,40 as is demonstrated hereinafter. FIGS. 3A–3H shows the various operational positions of the present invention as the drive means 55 causes the shaft 60 to complete a full counterclockwise revolution.

Figure 3A:
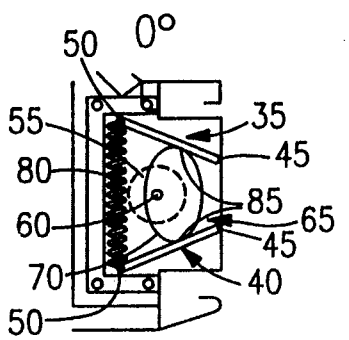
FIGS. 3A through 3H are schematic illustrations of the present invention in various operational positions as the drive means completes a full revolution.

In FIG. 3A, the shaft 60 is in the zero degree position. In this position, the discs 65 cause louver blade 35 to angle downwardly and the louver blade 40 to angle upwardly so as to "pinch" the air passing therebetween, causing it to increase in velocity and thereby extend farther out into the desired area 20. In this position, the downward angle of louver blade 35 is substantially equal to the upward angle of louver blade 40 such that the resultant direction of the airflow is generally in a horizontal plane. The above-mentioned pinching is desirable because the increase in the airflow's "throw", which results from the pinching, distributes the conditioned air farther into the desired area 20.

Figure 3B:
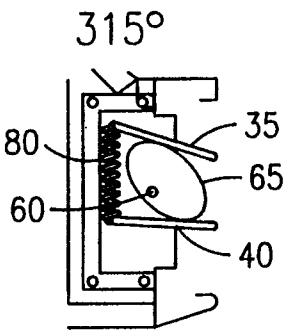

In FIG. 3B, the shaft 60 has rotated counterclockwise to the 315 degree position wherein the downward angle of louver blade 35 is no longer substantially equal to the upward angle of louver blade 40. The downward angle of louver blade 35 is slightly decreased, and the upward angle of louver blade 40 is substantially decreased to zero. Here there is some, but less, pinching of the airflow stream, and the resultant airflow direction is in a downward direction with respect to the horizontal plane.

Figure 3C:
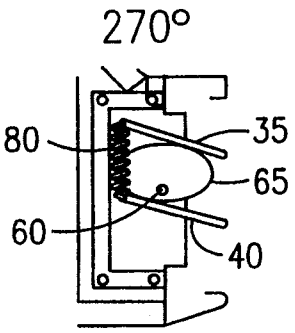

In FIG. 3C, the shaft 60 has rotated to the 270 degree position, with louver blade 35 in substantially the same downward angle as compared to FIG. 3B and louver blade 40 in substantially the same angle as louver blade 35 such that both louver blades 35,40 are essentially parallel. Here, there is no pinching of the airflow stream, and the resultant direction has moved downwardly, with less throw, as compared to the FIG. 3B position.

Figure 3D:
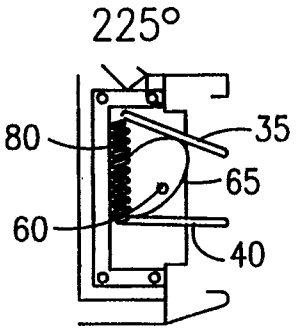

In FIG. 3D, the shaft 60 has moved to the 225 degree position, with the downward angle of louver blade 35 increased and the downward angle of louver blade 40 decreased to substantially zero as compared to FIG. 3C. Here, there is a pinching of airstream flow with the associated increase in throw, and the resultant airflow is in a downward direction with respect to the horizontal plane.

Figure 3E:
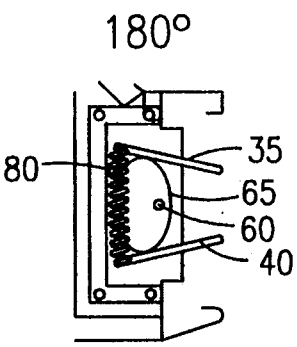

In FIG. 3E, the shaft 60 has moved to the 180 degree position wherein the downward angle of louver blade 35 is substantially equal to the upward angle of louver blade 40 such that the resultant direction of the airflow is generally in a horizontal plane identical to that in FIG. 3A. Here, there is a pinching of the airflow stream, thereby resulting in an increase in the throw of the airflow as compared to FIG. 3D.

Figure 3F:
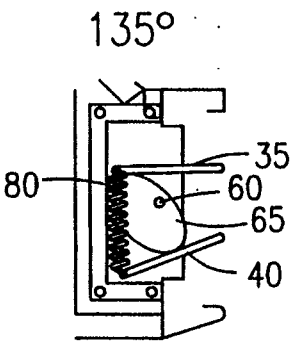

In FIG. 3F, the shaft 60 has rotated to the 135 degree position, and the louver blade 35 has decreased its downward angle to approximately zero degrees, and the louver blade 40 has slightly increased its upward angle. Here again there is some, but less, pinching of the airflow stream, and the resultant airflow stream is in an upward direction from the horizontal plane.

Figure 3G:
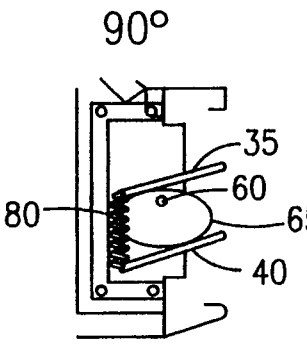

In FIG. 3G, the shaft 60 has rotated to the 90 degree position, with louver blade 35 in substantially the same upward angle as louver blade 40 such that both louver blades 35,40 are essentially parallel. Here, there is no pinching of the airflow stream, thereby resulting in a decrease in the throw of the airflow.

Figure 3H:
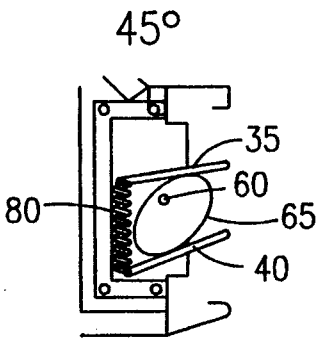

In FIG. 3H, the shaft 60 has moved to the 45 degree position, with the upward angle of louver blade 35 decreased and the upward angle of louver blade 40 increased as compared to FIG. 3G. Here, there is a pinching of airstream flow with the associated increase in airflow throw, and the resultant airflow stream direction is in the upward direction with respect to the horizontal plane.

Thus, as the FIGS. 3A–3H demonstrate, a full revolution of the shaft 60 provides the desired rotational pattern of the discs 65 which causes a vertical sweep of the airflow while simultaneously varying the throw of the airflow. In addition to the vertical airflow sweep, as described above, the present invention provides a horizontal sweep of the airflow as will be described hereinafter.

FIGS. 4A through 4D shows the present invention in various operational positions as the drive means 55 completes a full revolution. As described above, the discs 65 are preferably mounted on the shaft 60 such that each disc 65 has its plane disposed at an angle (e.g. forty-five degrees) with respect to the plane normal to the shaft's axis 75. Mounting the discs 65 in this manner allows the discs 65, as they rotate, to redirect the airflow either to the right or the left, depending on the rotational position of the discs 65. The resultant airflow direction oscillates between an extreme left angle and an extreme right angle as the discs 65 rotate about the shaft's axis 75.

In FIG. 4A, the shaft 60 is in the zero degree position. In this position, the discs 65 provide maximum resistance to the airflow and are substantially at a forty-five degree angle to the left with respect to the forward direction of an unobstructed airflow emanating from the discharge opening 15. Thus, the resultant airflow direction is substantially forty-five degrees to the right as viewed from the front of the unit. As the shaft 60 rotates counterclockwise toward the 270 degree position, the discs 65 provide less resistance to the airflow, thereby decreasing the side to side redirection of the airflow caused by the discs 65.

In FIG. 4B, the shaft 60 has rotated counterclockwise to the 270 degree position, whereby the discs 65 provide minimum resistance to the airflow emanating from the discharge opening 15. Here, the discs 65 do not alter the resultant airflow direction regarding the right or left direction with respect to the drawing. As the shaft 60 rotates counterclockwise toward the 180 degree position, the discs 65 provide more resistance to the airflow, thereby increasingly redirecting the airflow.

In FIG. 4C, the shaft 60 is rotated to the 180 degree position. In this position, the discs 65 again provide maximum resistance to the airflow and are substantially at a forty-five degree angle to the right with respect to the forward direction of an unobstructed airflow emanating from the discharge opening 15. Thus, the resultant airflow direction is substantially forty-five degrees to the left as viewed from the front of the unit. As the shaft 60 rotates counterclockwise toward the 90 degree position, the discs 65 provide less resistance to the airflow, thereby decreasing the side to side redirection of the airflow caused by the discs 65.

In FIG. 4D, the shaft 60 has rotated to the 90 degree position, whereby the discs 65 again provide minimum resistance to the airflow emanating from the discharge opening 15. Here, the discs 65 do not alter the resultant airflow direction regarding the right or left direction with respect to the drawing. As the shaft 60 rotates back to the zero degree position, the discs 65 provide greater resistance to the airflow until the discs 65 reach the zero degree position where the resistance to the airflow is again at the maximum. Thus, as the FIGS. 4A–4D illustrate, a full revolution of the shaft 60 produces an airflow which oscillates between an extreme left angle and an extreme right angle as the discs 65 rotate about the shaft's axis 75.

Thus, the present invention provides both a vertical and a horizontal sweep of the airflow while simultaneously varying the airflow's throw. Furthermore, the present invention does not require a direct linkage between the drive means and the louver blades, thereby reducing manufacturing costs and increasing efficiency. Therefore, the present invention provides enhanced air distribution performance with a low cost and non-complex design.

Although the invention has been shown and described with respect to a best mode embodiment thereof, it should be understood by those skilled in the art that various other changes, omissions and additions in the form and detail thereof may be made therein without departing from the spirit and scope of the invention.

What is claimed is:

1. An improved air sweep mechanism of the type disposed in an air discharge opening of an air conditioner system for automatically directing and sweeping the airflow emanating therefrom, wherein the improvement comprises:

a shaft extending across the air discharge opening and rotatably mounted therein;

drive means operatively connected to said shaft for rotating said shaft on its axis;

a plurality of discs disposed in spaced relationship on said shaft such that for each disc, the distance between at least one point on its periphery and the axis of said shaft is larger than the distance between another point on its periphery and the axis of said shaft;

a pair of adjacent louver blades extending across the air discharge opening, each louver blade having first and second edges and being pivotally mounted in the air discharge opening about its first edge; and biasing means for biasing said louver blade second edges toward each other to thereby cause an engaging relationship between said discs and said pair of louver blades such that as said discs rotate, the louver blades are caused to pivot about their first edges thus causing a change in the direction of airflow emanating from the discharge opening.

2. An apparatus as recited in claim 1 wherein said biasing means comprises a tension spring connected between said louver blades.

3. An apparatus as recited in claim 1 wherein said pair of louver blades are disposed on opposite sides of the shaft.

4. An apparatus as recited in claim 1 wherein said plurality of discs are elliptical in shape.

5. An apparatus as recited in claim 1 wherein said plurality of discs are substantially planar and are mounted on said shaft such that each disc has its plane angled with respect to a plane normal to the axis of said shaft.

6. An apparatus as recited in claim 5 wherein each disc is so mounted as to have its plane at an angle of substantially forty-five degrees with respect to the plane normal to the axis of said shaft.

7. An improved air sweep mechanism of the type disposed in an air discharge opening of an air conditioner system for automatically directing and sweeping the airflow emanating therefrom, wherein the improvement comprises:

a shaft disposed across the air discharge opening and rotatably mounted therein;

a plurality of elliptically shaped discs mounted in axially spaced relationship on said shaft;

a pair of adjacent louver blades disposed on opposite sides of said shaft, with each having first and second edges and being pivotally mounted at its first edge;

biasing means connected to said louver blades for biasing said louver blade second edges toward each other thereby causing said pair of louver blades to engage said plurality of discs; and drive means operatively connected to said shaft for rotating said shaft and said discs about the axis of said shaft thereby causing said louver blades to pivot about their first edges which in turn causes sweeping of the conditioned air through a plane normal to the axis of the shaft as it passes between said pair of louver blades.

8. An apparatus as recited in claim 7 wherein said biasing means comprises a tension spring.

9. An apparatus as recited in claim 7 wherein said drive means comprises a motor.

10. An apparatus as recited in claim 7 wherein said discs are substantially planar in form and are angularly mounted to said shaft such that each disc has its plane at an angle with respect to a plane normal to the axis of said shaft thereby sweeping the airflow through a plane of said axis.

11. An apparatus as recited in claim 10 wherein each of said discs is mounted to said shaft with its plane being substantially at forty-five degrees with respect to the plane normal to the axis of said shaft.

* * * * *